US009573016B2

(12) United States Patent
Haddad et al.

(10) Patent No.: US 9,573,016 B2
(45) Date of Patent: Feb. 21, 2017

(54) EXERCISE DEVICE FOR SUPPORTING WEIGHT FROM HAND GRIPS USING STRAPS

(71) Applicant: MYT Equipment Inc., Winnipeg (CA)

(72) Inventors: Sami Ishag Jamil Haddad, Winnipeg (CA); Stephen John Davies, Winnipeg (CA)

(73) Assignee: MYT EQUIPMENT INC., Winnipeg, Manitoba (CA)

( * ) Notice: Subject to any disclaimer, the term of this patent is extended or adjusted under 35 U.S.C. 154(b) by 8 days.

(21) Appl. No.: 14/724,180

(22) Filed: May 28, 2015

(65) Prior Publication Data

US 2016/0016032 A1 Jan. 21, 2016

Related U.S. Application Data

(63) Continuation-in-part of application No. 13/467,692, filed on May 9, 2012, now abandoned.

(60) Provisional application No. 61/518,483, filed on May 9, 2011.

(51) Int. Cl.

| | |
|---|---|
| ***A63B 21/06*** | (2006.01) |
| ***A63B 21/00*** | (2006.01) |
| ***A63B 23/12*** | (2006.01) |
| ***A63B 69/00*** | (2006.01) |
| ***A63B 21/075*** | (2006.01) |

(52) U.S. Cl.

CPC ..... *A63B 21/4043* (2015.10); *A63B 21/0004* (2013.01); *A63B 21/00069* (2013.01); *A63B 21/06* (2013.01); *A63B 21/0603* (2013.01); *A63B 21/0608* (2013.01); *A63B 21/075* (2013.01); *A63B 21/0722* (2015.10); *A63B 21/4035* (2015.10); *A63B 23/12* (2013.01); *A63B 69/0024* (2013.01); *A63B 2069/0008* (2013.01)

(58) Field of Classification Search

CPC ..... A63B 21/4035; A63B 21/0724; A63B 21/0728; A63B 21/075; A63B 21/4017; A63B 21/4019; A63B 21/4021; A63B 21/4043; A63B 21/06

USPC ..... 482/93, 99, 104

See application file for complete search history.

(56) References Cited

U.S. PATENT DOCUMENTS

| | | | | | |
|---|---|---|---|---|---|
| 882,181 | A | * | 3/1908 | Thomas | 482/139 |
| 1,517,147 | A | * | 11/1924 | Burnett | 482/10 |
| 3,115,339 | A | * | 12/1963 | Forte | 482/139 |
| 3,751,031 | A | * | 8/1973 | Yamauchi | |
| 4,084,815 | A | * | 4/1978 | Flannery | 482/94 |
| 4,229,002 | A | * | 10/1980 | Masters | 482/94 |
| 4,373,716 | A | * | 2/1983 | Pagani | 482/130 |
| 4,489,935 | A | * | 12/1984 | Lusk | 482/109 |

(Continued)

*Primary Examiner* — Loan H Thanh
*Assistant Examiner* — Rae Fischer
(74) *Attorney, Agent, or Firm* — Ryan W. Dupuis; Kyle R. Satterthwaite; Ade & Company Inc

(57) ABSTRACT

An exercise device is formed of inelastic, fixed length, substantially rigid straps connected in a T-shaped configuration so as to define an anchor member and two support members. An anchor loop is fixed to the outer end of the anchor member for securing a weighted member thereon or for securing to various stationary objects. A hand grip is coupled to the outer end of each support member such that the user must exert additional effort during various exercises to maintain proper position of their hands relative to one another.

10 Claims, 10 Drawing Sheets

(56) References Cited

U.S. PATENT DOCUMENTS

| | | | | | |
|---|---|---|---|---|---|
| 4,544,155 | A * | 10/1985 | Wallenbrock et al. | ..... | 482/129 |
| 4,647,037 | A * | 3/1987 | Donohue | ..... | 482/82 |
| 4,756,527 | A * | 7/1988 | Ledbetter | ..... | 482/139 |
| 5,029,850 | A * | 7/1991 | van Straaten | ..... | 482/125 |
| 5,273,509 | A * | 12/1993 | Vittone | ..... | 482/139 |
| 5,518,486 | A * | 5/1996 | Sheeler | ..... | 482/131 |
| 5,588,940 | A * | 12/1996 | Price et al. | ..... | 482/105 |
| 5,718,654 | A * | 2/1998 | Kennedy | ..... | 482/139 |
| 6,692,416 | B1 * | 2/2004 | Davis | ..... | 482/139 |
| 7,044,896 | B2 | 5/2006 | Hetrick | | |
| 7,275,669 | B1 * | 10/2007 | Aikens | ..... | 224/420 |
| 7,377,299 | B2 * | 5/2008 | Gerber et al. | ..... | 150/108 |
| 7,410,451 | B2 * | 8/2008 | Williams | ..... | 482/139 |
| 8,007,413 | B1 * | 8/2011 | Wu | ..... | 482/91 |
| 8,276,351 | B1 * | 10/2012 | Henkin | ..... | 53/469 |
| 2005/0085350 | A1 | 4/2005 | Shen | | |
| 2006/0100067 | A1 * | 5/2006 | Washburn et al. | ..... | 482/83 |

* cited by examiner

EXERCISE DEVICE FOR SUPPORTING WEIGHT FROM HAND GRIPS USING STRAPS

This application is a continuation-in-part of U.S. parent application Ser. No. 13/467,692, filed May 9, 2012, which claims the benefit under 35 U.S.C. 119(e) of U.S. provisional application Ser. No. 61/518,483, filed May 9, 2011.

FIELD OF THE INVENTION

The present invention relates to an exercise device including hand grips and an anchor loop for connection to a weighted member for performing various free-weight exercises, and more particularly the present invention relates to an exercise device generally comprising three strap members connected in a Y-shaped configuration between the anchor loop connected to the weighted member and the two hand grips.

BACKGROUND

Currently, there exist only a couple of pieces of basic exercise equipment that allow for rotational plane exercises. The most popular being a medicine ball with a rope attached to it. The premise of this system is that the individual holds onto the rope with their hands and swings the ball in whatever rotational plane they desire. When the rotational plane is reversed, a plyometric contraction takes place as the body employs antagonistic muscles to reverse the rotational forces.

The device can also be used in a manner that allows the ball to strike a solid body like the ground or a solid wall. This action allows for the rapid deceleration of the weight and assists the individual in changing the direction of rotation without having to retard the velocity using muscular force. This allows for the individual to rapidly disengage the agonist muscles and engage the antagonist muscles without the need to slowly decelerate the movement first with muscle resistance.

Although this system is an effective way of developing core muscles and creating explosive muscle contractions, it is limited in the following ways. First, the rope is a singular extension from the medicine ball which allows the rope to be held only in a manner similar to holding a baseball bat. This causes the forces that act on the rope to pivot at the top of the griping hand closest to the medicine ball. Since the rope is flexible and incapable of transferring the forces further past the pivot point of the closest hand, the further hand offers no assistance in inducing or retarding any forces created once the medicine ball is put in motion. This creates an asymmetrical action, where only one arm is truly being exercised. This in turn causes the core to be utilized in an asymmetrical fashion that could potentially lead to over use injuries.

Second, the rope is directly tied to the medicine ball. This causes binding of the rope as the ball spins around its own axis of rotation. This binding causes torque forces to travel the rope. This torque force can work against the grip of the user and can dramatically limit the life of the product.

Third, the functionality of the system is limited to dynamic rotational exercises. The only exercises that can be conducted statically involve suspending the ball from the rope and using muscle force to fight gravity in the opposite direction. This means that the system only allows for resistance directly upwards from the ground. Add to this that only one arm truly assists in this movement and the static exercises are extremely limited.

Fourth, the rope system causes extreme friction to the hands of the user causing extreme discomfort from both friction and the binding forces from the leverage point created at the end of the grip. This is typically compounded by the fact that users will wrap the rope around their hand to give extra gripping ability. This causes the rope to exert an enormous squeezing force across the metacarpals that could lead to serious injury.

Finally, this system utilizes a fixed weight. The rope is permanently affixed to the medicine ball. This means that anyone wanting to utilize a larger or smaller weight must purchase an entirely separate unit.

U.S. Pat. No. 7,044,896 by Hetrick discloses one example of an exercise device using two inelastic straps connected to respective hand grips in which the straps are commonly anchored to a suitable anchor which is secured to a stationary object. The user can thus perform various exercises but is generally limited to exercises working against the stationary object or using their own body weight as resistance.

SUMMARY OF THE INVENTION

According to one aspect of the invention there is provided an exercise device comprising:

an anchor member which is inelastic and elongate between an inner end and an outer end of the anchor member;

an anchor loop fixed to the outer end of the anchor member so as to be arranged to secure a weighted member to the outer end of the anchor member;

two support members, each support member being inelastic and elongate between an inner end coupled to the inner end of the anchor member and an outer end opposite from the inner end;

a support loop fixed to the outer end of each support member; and two hand grips coupled to respective ones of the support loops of the two support members such that each hand grip is arranged to be gripped in a respective hand of a user;

each support member being rigid and inelastic between the inner end and the outer end thereof; and each support member being pivotally coupled at the inner end of the support member relative to the inner end of the anchor member.

The combination of anchor member and support members in a resulting Y-shaped configuration permits any type of weighted member to be suspended from two hand grips which remain independent from one another. Accordingly, when performing either isometric or dynamic exercises, the user must use many more stabilizer muscles than conventional free weight exercises as the user must both i) keep their hands in line with one another, and ii) apply additional force to control the spacing between their hands resulting from the free pivoting of the support members relative to the anchor member.

Preferably the anchor member is rigid and inelastic between the inner end and the outer end thereof.

Preferably the anchor member and the support members are coupled in a Y-shaped configuration relative to one another in which each of the anchor member and the support members comprises an inelastic strap of fixed length.

Preferably each support member is fixed in length between the inner end and the outer end thereof. Each support member may have a fixed length of between 4 and 12 inches, and more preferably between 5 and 7 inches between the inner end and the outer end thereof.

Preferably the anchor member is also fixed in length between the inner end and the outer end thereof, for example having a fixed length of less than 12 inches between the inner end and the outer end thereof.

Preferably each support member comprises two outer layers and a rigid core body received between the two outer layers along a full length of the support member between the inner end and the outer end thereof, each outer layer comprising a flat strap having two opposing side edges spanning a length of the support member between the inner end and the outer end thereof, the two outer layers being joined two one another along the two opposing side edges respectively along opposing sides of the rigid core body received therebetween.

Preferably each support member comprises a flat strap stitched to the anchor member at the inner ends of the anchor member and the support member, and wherein pivotal coupling of the support members relative to the anchor member is defined by flexing of the flat straps at the inner ends of the support members.

Preferably each one of the support members and the anchor member comprise a flat strap having a width between two opposing side edges, each support member being joined to the anchor member across the full width of the support member and the anchor member.

Preferably each hand grip comprises a generally cylindrical gripping body which is elongate between a coupling end which is coupled to the respective support loop and an opposing free end which is unsecured. Preferably the body varies in diameter along a length of the body between the coupling end and the free end to define lobed portions and recessed portions at respective positions along the length of the body. Preferably a swivel couples each body to the respective support member.

The device may be used in combination with a hook member supported on the anchor loop and a free weight disc supported on the hook member.

Alternatively, a bag member may be supported on the hook member in which the bag member comprises a hollow interior locating a plurality of sand bags therein, an open top end arranged to receive the sand bags therethrough, and a plurality of anchor loops mounted at spaced position about the open top end in which the anchor loops are commonly secured on the hook member.

Alternatively a ball supporting device may be provided comprising a plurality of strap members coupled to one another to define a receptacle with an open top end arranged to receive a weighted ball therein in which the strap members are joined to respective anchor loops commonly secured on the hook member.

According to a second aspect of the present invention there is provided an exercise device comprising:

an anchor member which is inelastic and fixed in length between an inner end and an outer end of the anchor member;

an anchor loop fixed to the outer end of the anchor member so as to be arranged to secure a weighted member to the outer end of the anchor member;

two support members, each support member being substantially rigid and inelastic and being fixed in length between an inner end pivotally coupled to the inner end of the anchor member and an outer end opposite from the inner end;

a support loop fixed to the outer end of each support member;

two hand grips coupled to respective ones of the support loops of the two support members such that each hand grip is arranged to be gripped in a respective hand of a user in which each hand grip comprises a generally cylindrical gripping body which is elongate between a coupling end coupled to the respective support loop and an opposing free end which is unsecured;

each one of the support members and the anchor member comprising a flat strap having a width between two opposing side edges; and each support member being joined to the anchor member across the full width of the support member and the anchor member.

According to a further aspect of the present invention of there is provided an exercise device comprising:

an anchor member which is inelastic and elongate between an inner end and an outer end of the anchor member;

an anchor loop fixed to the outer end of the anchor member;

a hook member supported on the anchor loop so as to be readily releasable from the anchor loop;

a weighted member suspended from the anchor loop by the hook member;

two support members, each support member being inelastic and elongate between an inner end coupled to the inner end of the anchor member and an outer end opposite from the inner end;

a support loop fixed to the outer end of each support member; and two hand grips coupled to respective ones of the support loops of the two support members such that each hand grip is arranged to be gripped in a respective hand of a user;

each support member being pivotally coupled at the inner end of the support member relative to the inner end of the anchor member; and each of the anchor member and the support members comprises an inelastic strap of fixed length.

In the second embodiment, a bag member preferably suspends the weighted member from the hook member in which the bag member comprises: i) a hollow interior locating the weighted member therein; ii) an open top end arranged to receive the sand bags therethrough; and iii) a plurality of anchor loops mounted at spaced position about the open top end, the anchor loops being commonly secured on the hook member.

According to some of the embodiments of the present invention described herein there is provided numerous benefits beyond prior art devices as described in the following:

i) The invention utilizes a strapping system that adds rigidity. This assists with the transfer of forces if the weighting system losses centripetal or centrifugal forces. This will also allow the weight to be moved at slower speeds than the traditional rope system without loss of control or creating potentially harmful jerking motions.

ii) The strapping system utilizes a "Y" configuration. This configuration splits the strapping system leading from the weight. By doing this it allows for the user to use each hand to hold on to the two individual straps which meet together at the same place on the primary strap that is affixed to the weight. This allows for both arms to become directly involved in inducing and retarding forces. This dramatically reduces the probability of injury while increasing the symmetrical involvement of the core.

iii) A handle allows for a comfortable grip that causes all forces to be equally spread across the palm of the hand. This is the optimal location for forces to act when utilizing the hand to overcome resistance. This dramatically reduces fatigue in the hand, extending the time exercises can continue. It also dramatically reduces the possibility of injury.

iv) The handles utilize quick release connectors to attach them to the "Y" strap. This allows for quick removal of one of the handles and for the remaining handle to be attached to both ends of the "Y" strapping. This is done for individuals that desire to exercise only one arm at a time in a similar manner to existing systems.

v) The "Y" strapping and handles allow for rotation to occur in separate planes for each hand. This is extremely beneficial as it creates an infinite number of ways that the arms can be placed during acceleration and deceleration of the weight. This is important as the invention was primarily developed to address sports specific training. The current products can only address rotation with both arms always acting on the same plane. This limits the ability for users to recreate the same movement utilized in their specific sport.

vi) The "Y" strapping allows for multi direction forces to be applied when the invention is used in a static manner. As mentioned, existing systems only allow for static resistance to occur only on the y-axis. The "Y" strapping allows for the invention to allow for static resistance to occur on the y-axis, x-axis and z-axis. This increases the number of static exercises to an extremely high number as any variation of the three axis's will alter the location on the body where the force is acting.

vii) The end of the "Y" strap that is affixed to the weight can utilizes a swivel attachment. This swivel prevents torque forces to be transferred to the strap. This prevents binding, extends the life of the product and removes torque from being transferred to the hands of the user.

viii) The present invention utilizes a universally adjustable weight holding system. This allows for quick increase and decrease of weight as desired for specific exercises. It also allows for variation in the type of weight being utilized. It ensures that the force of the weight against the holding system is equally transferred to the swivel attachment. The holding device can be used to hold medicine balls, sand or steel shot neoprene bags, or more traditional weighting systems. This allows for flexibility in use, cost savings and the ability to utilize the strapping system while traveling without the need to pack a heavy and bulky weight.

According to another aspect of the present invention there is provided a method of exercising comprising:

(a) providing an exercise device comprising:

(i) an anchor member which is flat, inelastic and fixed in length between an inner end and an outer end of the anchor member;

(ii) an anchor loop fixed to the outer end of the anchor member so as to be arranged to secure a weighted member to the outer end of the anchor member;

(iii) two support members, each support member being substantially flat, inelastic and being fixed in length between an inner end pivotally coupled to the inner end of the anchor member and an outer end opposite from the inner end, the two support members being pivotal relative to the anchor member about a common pivotal axis which lies in a flat plane of each of the anchor member and the two support members;

(iv) a support loop fixed to the outer end of each support member; and (v) two independent hand grips coupled to the support loops of the two support members respectively; and (b) enabling a weighted member to be supporting on the anchor loop at the outer end of the anchor member;

(c) gripping the hand grips in respective hands of the user; and (d) pulling the hand grips laterally apart from one another such that the two support members are substantially coplanar and the anchor member is perpendicularly oriented relative to the two support members so as to suspend the weighted member below the common pivotal axis.

Preferably the method includes displacing the weighted member through a range of motion while maintaining the two support members substantially coplanar with one another and the anchor member perpendicularly oriented relative to the two support members so as to suspend the weighted member below the common pivotal axis from a starting position to an ending position.

The exercise may comprise a squat exercise including the steps of the user standing in the starting position with the arms of the user extending forwardly and the hand grips at a shoulder spacing relative to one another, and the user performing a squat from the starting position to the ending position while the arms of the user remain extending forwardly and the hand grips at a shoulder spacing relative to one another.

The exercise may comprise a shoulder flexion including the steps of the user extending the arms of the user downwardly with the hand grips at a shoulder spacing relative to one another in the starting position and the user raising their arms from the starting position to the ending position in which the arms of the user extend forwardly and the hand grips are at a shoulder spacing relative to one another.

The exercise may comprise a chest press exercise including the steps of the user extending the upper arms of the user laterally outwardly in opposing directions with the hand grips at a shoulder spacing relative to one another in proximity to shoulders of the user in the starting position, and the user extending their arms forwardly from the starting position to the ending position in which the arms of the user extend forwardly and the hand grips are at a shoulder spacing relative to one another.

The exercise may comprise a bent over row exercise including the steps of the user leaning their torso forwardly and extending the arms of the user downwardly with the hand grips at a shoulder spacing relative to one another in the starting position and the user raising their arms from the starting position to the ending position in which the arms of the user are folded and the hand grips are at a shoulder spacing relative to one another in proximity to shoulders of the user.

Various embodiments of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
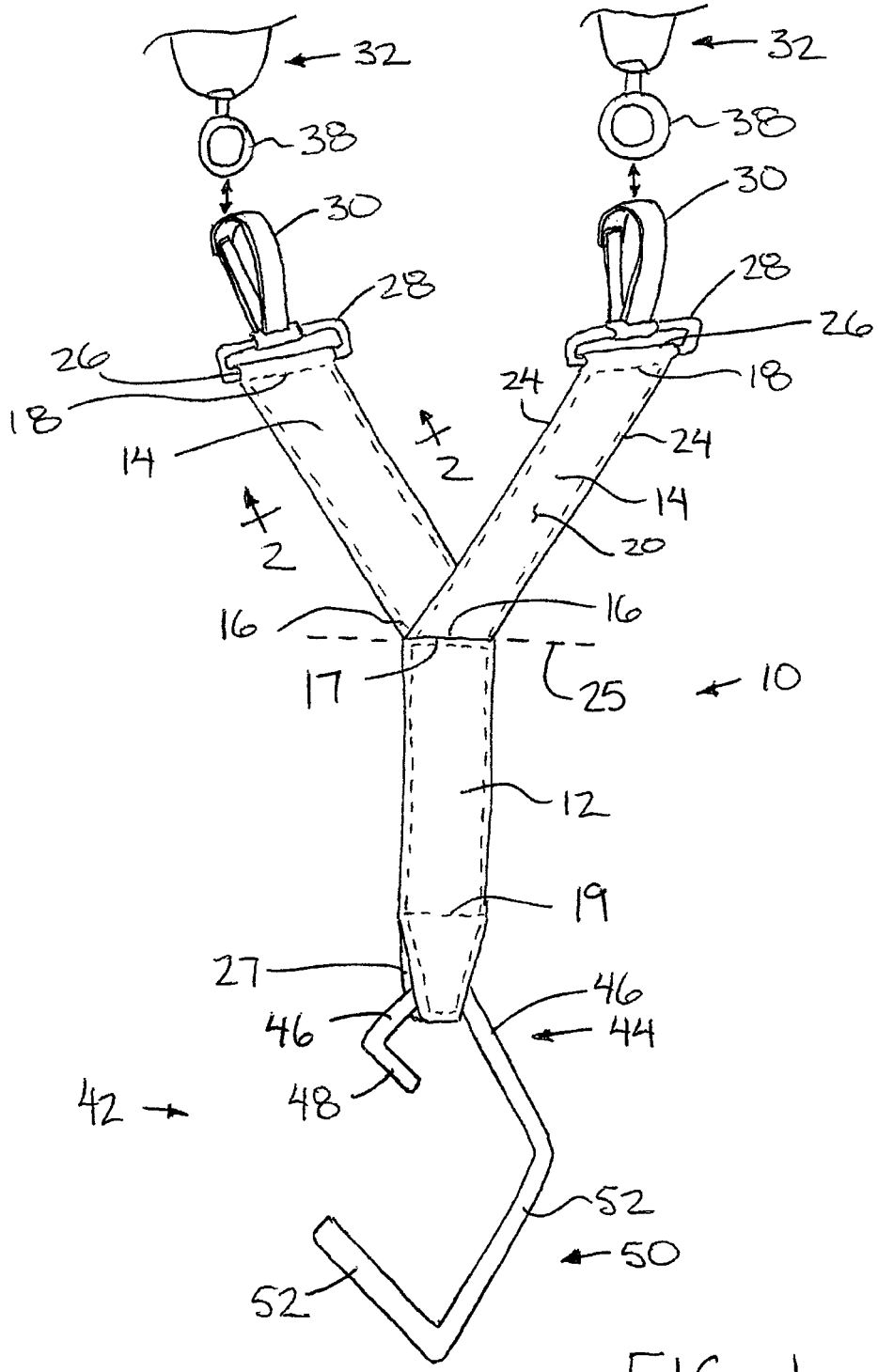
FIG. 1 is a perspective view of a first embodiment of the exercise device.
Figure 2:
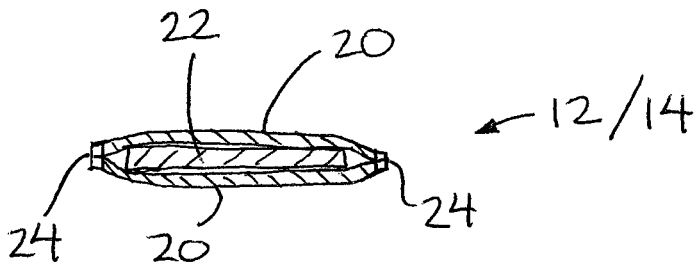
FIG. 2 is a sectional view along the line 2-2 of FIG. 1.
Figure 3:
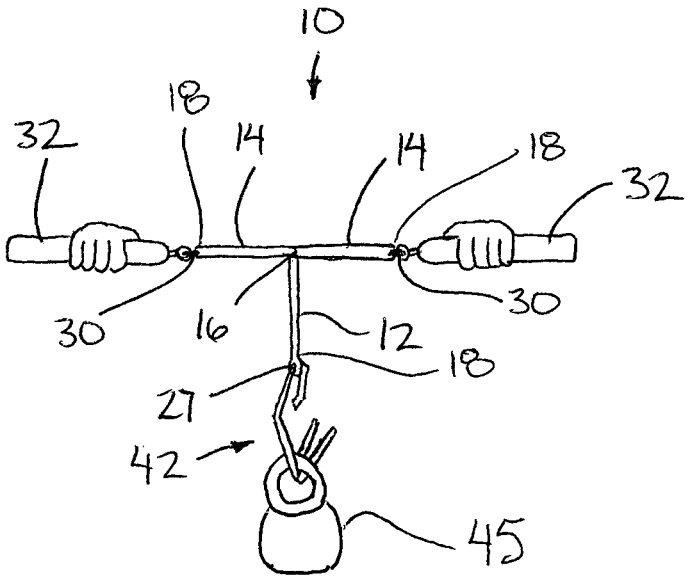
FIG. 3 is a front elevational view of the exercise device according to FIG. 1 in use.
Figure 5:
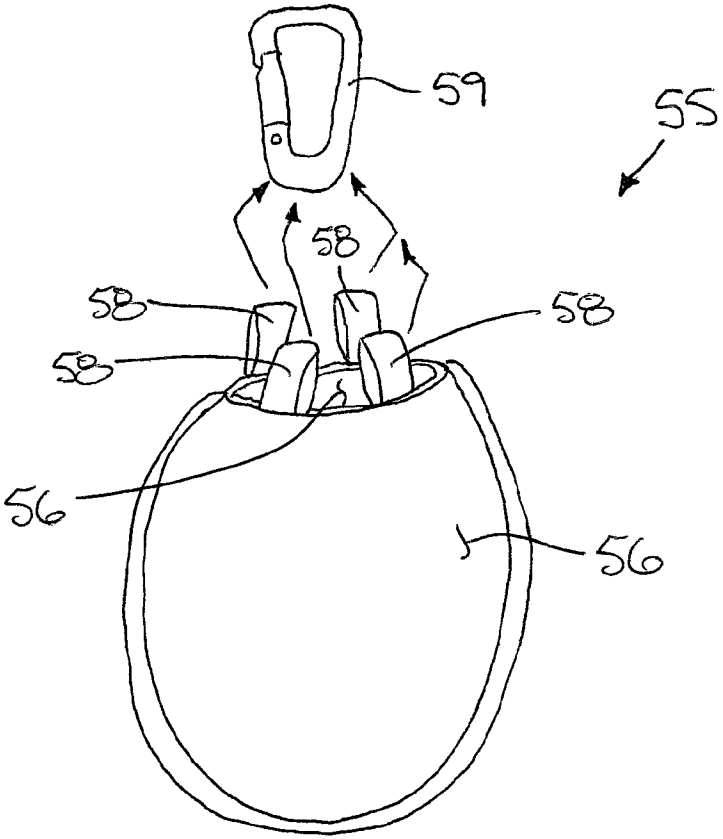
FIG. 5 is a perspective view of one embodiment of a weighted device.
Figure 4:
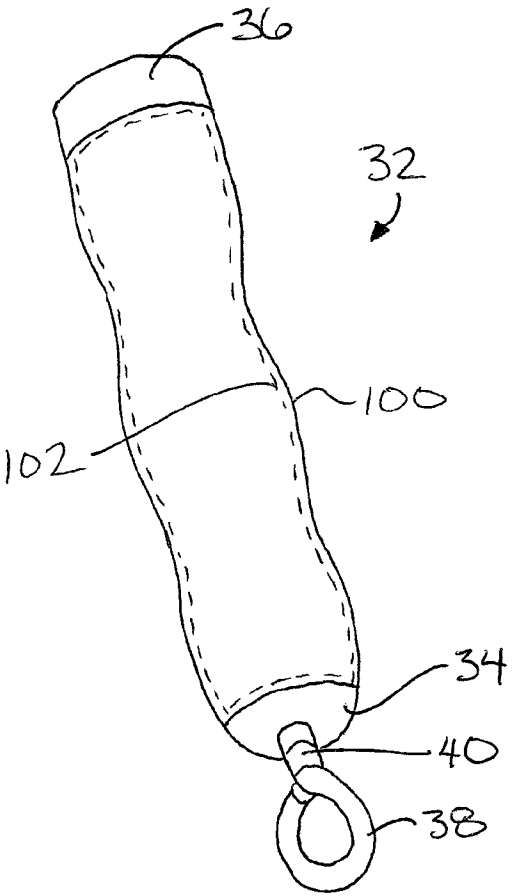
FIG. 4 is a perspective view of a first embodiment of a hand grip.

Referring to the accompanying figures there is illustrated an exercise device generally indicated by reference numeral 10. The device 10 generally relates to a strapping accessory coupled between various gripping devices and various weighted devices for performing free weight exercises including isometric exercises and exercises including ranges of motion.

Turning now to FIGS. 1 through 5, according to a first embodiment, the device 10 generally includes an anchor member 12 and two support members 14 formed of strap material which are joined in a Y-shaped configuration. Each of the support members 14 is elongate between and inner end 16 and an opposing outer end 18 so as to be inelastic, substantially rigid, and fixed in length between the inner and outer ends. Similarly, the anchor member 12 is elongate between and inner end 17 and an opposing outer end 19 so as to be inelastic, substantially rigid, and fixed in length between the inner and outer ends.

Each of the support members and the anchor member is formed of two outer layers 20, each formed of flat straps of flexible woven material and one core layer 22 received therebetween. Each strap has a constant width defined between two opposing side edges 24 which extend in the longitudinal direction a full length of the member between the opposing inner end and outer end thereof. Within each member the two side edges 24 of one outer layer are joined to the corresponding two side edges of the other outer layer to define a pocket therebetween which spans a full length and which receives the core layer 22 therein.

The core layer 22 comprises a rigid flat body spanning the full width and full length of the outer strap layers between which it is received. The anchor member 12 and the two support members 14 are all substantially identical in width, for example two inches in the illustrated embodiment, as well as being similar in length, for example near six inches in the preferred illustrated embodiment.

The inner end 16 of each support member 14 is stitched across the full width thereof to the inner end 17 of the anchor member 12 across the full width thereof. The portion of flexible strap material at the inner end 16 of each support member 14 which is joined by stitching to the anchor member 12 defines a pivotal coupling between the inner end 16 of each support member 14 and the inner end 17 of the anchor member 12 such that the two support members 14 have a common pivotal axis 25 parallel to the flat width of the members.

In this manner, the rigid core bodies of the support members each extend from an outer end at the outer end of the support member to respective inner ends of the rigid core bodies substantially at the common pivotal axis at the inner end of each support member. The rigid core of the anchor member similarly extends from an outer end of the rigid core body at the outer end of the anchor member to an inner end of the rigid core body at the common pivotal axis at the inner end of the anchor member. In this arrangement, the two support members can be pivotal relative to the anchor member about the common pivotal axis which lies at an intersection of the flat plane of the anchor member with the flat plane of the support members. The flat rigid cores provide stable support to the support members such that, when the hand grips are pulled laterally apart from one another in respective hands of the user, the two support members can be oriented substantially coplanar with one another. Furthermore, the flat rigid core of the anchor member provides stable support to the anchor member relative to the support members such that the anchor member can be perpendicularly oriented relative to the two support members so as to suspend the weighted member below the common pivotal axis in a stable orientation throughout an exercising range of motion. Various exercises are described further below with particular reference to FIGS. 12 through 17.

Within each member 12 and 14, the two outer layers 20 are integrally joined with one another to define a loop of the strap material protruding longitudinally beyond the end of the core layer 22 at the outer end for anchoring various accessories thereon. The integral loop of strap material is formed by folding a common strap member to define the two outer layers of each member which are then stitched together along the two opposing side edges 24.

On each support member 14, the loop of material defines a support loop 26 spanning the full width of the support member 14. A metal annular link 28 having a width corresponding approximately to the width of the support loop 26 is retained within each loop. A first snap hook 30 is secured to each annular link 28 diametrically opposite from the support loop retaining a portion of the annular link therein for being selectively clipped onto various grip accessories as described in further detail below.

On the anchor member 12, the loop of material at the outer end 19 defines an anchor loop 27 which has side edges folded inwardly so as to be narrower in width at the outer end opposite the remainder of the anchor member 12 so as to be suitable for hooking various weight accessories thereon also as described in further detail below.

The device 10 includes two hand grips 32 arranged to be connected to the first snap hooks 30 of the two support loops 26 respectively. Each hand grip includes an elongate and generally cylindrical body having a rigid core extending between a coupling end 34 and an opposing free end 36. A connecting loop 38 of rigid metal is connected to the coupling end 34 by a swivel assembly 40 permitting the connecting loop 38 to be pivotal about a longitudinal axis of the generally cylindrical body. The connecting loop 38 is suitably sized for being received within the hook portion of the first snap hook 30 of the respective support member 14.

The generally cylindrical body is ergonomically shaped to assist in gripping by the user. The ergonomic shape includes the coupling end of the generally cylindrical body being rounded and semi-spherical in shape. Furthermore, the diameter of the outer surface 102 of the generally cylindrical body varies along the length of the body to define some recessed areas where the outer diameter is reduced and some lobed areas at longitudinal positions between recessed areas where the outer diameter is increased in relation to the recessed areas.

The outer surface 102 of the generally cylindrical body further includes a layer of gripping material 100 conforming to the varying outer diameter of the generally cylindrical body and being integrally supported in a mating configuration with the outer surface of the generally cylindrical body which defines a rigid core surrounded by the gripping material.

By providing a coupling loop 38 at the coupling end of each generally cylindrical body with the opposing end of the generally cylindrical body being a free end, the hand grips can be gripped in the hand of the user such that the axial direction of the generally cylindrical body extends substantially co-axially with the longitudinal direction of the respective support member 14 to which it is coupled.

Among the various accessories arranged to be connected to the anchor loop 27 at the outer end of anchor member 12 is a multi-purpose hook accessory 42 arranged to hook various weighted devices 45 thereon. The hook accessory includes an upper hook portion 44 comprises of two upper leg portions 46 connected at an upper apex of the hook accessory so as to be near perpendicular to one another in the range of 80 degrees at the interior angle for example. The interior angle of the upper hook is arranged to be hooked and retained on the anchor loop 27 in use.

To assist in retaining the upper hook portion on the anchor loop, the upper hook further includes a retainer portion 48 extending inwardly from the bottom end of the one of the upper leg portions at an acute interior angle, for example 60 degrees.

The other upper leg portion of the upper hook portion is joined to a lower hook portion 50 also formed of two lower leg portions 52 meeting at an interior angle of approximately 80 degrees so as to be near perpendicular and defining a bottom apex opposite the top apex of the upper hook. One of the lower leg portions 52 of the lower hook is joined at an obtuse angle to the corresponding upper leg portion of the upper hook so as to define an interior angle of near 130 degrees for example.

The lower leg portions of the lower hook are longer than the upper leg portions of the upper hook to provide a broad hooking area for hooking various weighted members thereon including free weight discs, kettle bells and the like. One of the lower leg portions 52 of the lower hook defining the free end of the hook is formed by two bars which diverge from one another from the bottom apex to the free end of the hook to provide a broad supporting surface upon which a portion of a free weight disc may be supported for example.

In place of the hook accessory 42 various additional weighted accessories can be secured to the anchor loop 27 using a carabineer or other configuration such as a second snap hook 59 for example.

In one instance an enclosed bag 55 may be supported by a second snap hook 59 in which the bag is formed by two side panels 56 joined along opposing side edges and along the bottom edge to one another such that the top edges of the two side panels remain open therebetween. Connecting loops 58 are secured at spaced positions along both top edges of the two side panels 56 such that the connecting loops 58 may all be gathered together and commonly anchored to the second snap hook 59 for providing the dual function of maintaining the open top end of the bag in a closed position as well as suspending the bag from the anchor loop 27. The bag in this instance permits various soft weights to be received therein including sandbags and the like. The bag may be formed of durable canvas material, or in alternative embodiments the panels may be formed of a soft resilient neoprene material for example. In either instance the connecting loops 58 about the open top end of the bag are secured across a large area of the bag by suitable stitching for example.

In an alternative embodiment of the weighted device, an open mesh bag may be provided using an arrangement of various straps interconnected in a grid like pattern as shown in FIG. 6 through 11 to define a pocket or receptacle shape with an open top end of suitable size for receiving a medicine ball therein, for example. Ends of the various straps forming the mesh bag which surround the open top end include integral connecting loops (not shown) similar to the connecting loops 58 shown in FIG. 5 so as to be commonly gathered on a common snap hook (not shown) for coupling to the anchor loop 27 at the outer end of the anchor member 12 by a suitable swivel (not shown).

In further embodiments different types of hand grips may be used for connection to the support loops 26 at the outer ends of the two support members 14. One alternative hand grip configuration shown in FIGS. 6 through 11 comprises a rigid handle member including two end straps of equal length extending from opposing ends of the handle and joined to one another by a suitable hook to the respective support loop. In this instance the handle portion gripped by the user is held substantially perpendicularly to the longitudinal direction of the respective support member 14 rather than being substantially coaxial with the support member 14 as in the preferred embodiment described above.

In the preferred embodiment the user typically grasps the two hands grips in respective hands of the users with the hands of being held level with one another at a common elevation. The length of the two support members 14 is arranged such that when the user pulls their two hands apart to a spacing corresponding approximately to the space between their shoulders, the support members 14 are maintained in a near horizontal orientation with the anchor member 12 suspended therefrom at a central location between the two hands of the user.

The user typically holds the two hand grips 32 such that the longitudinal direction of the cylindrical bodies is substantially co-axial with the support members 14 and the support members 14 are pulled apart so as to be substantially co-axial with one another. The user may hold the grips with their arms extending forwardly in front of them with hands in either a palm facing up or palm facing down configuration. With a suitable weighted device suspended from the anchor loop 27 the user may perform isometric exercises by maintaining the support members 14 in a horizontal orientation by pulling their hands away from one another. Alternatively, the user may maintain the horizontal orientation through a range of motion, for example when performing arm curls. In addition to the upward curling motion, the configuration of the two support members 14 in a Y-shaped configuration with the anchor member 12 requires the user to exert considerable stabilizer muscles throughout the full range of the curling motion.

In other uses, the hook accessory 42 can be used for anchoring the device 10 to various stationary objects. For example, the hook 42 may be hooked onto a chin-up bar such that the user uses the hand grips of the exercise device 10 as an alternative means of gripping the chin-up bar.

In yet further uses, the anchor loop 27 or the hook accessory can be used for connection in place of any other type of hand grip of various exercise machines including cable pulled weight lifting equipment and the like. The independence of the two hand grips being pivotally connected to a common anchor location again requires the user to exert additional stabilizer muscles to level the hands of the user relative to one another instead of just pulling on the cable which only provides a linear resistance.

Turning now to FIGS. 6 through 11, in the second embodiment, the strapping system is designed to hold an item with sufficient mass to achieve a desired level of resistance that would be optimal for the individual utilizing the system. Primarily, the strapping would hold medicine balls, sand or steel shot neoprene bags, or more traditional weighting systems. The selection of the type of weighting system is important as it has a direct impact on the variety of exercises that can be performed safely by the individual. The medicine ball would represent the widest variety of exercises with a traditional steel weight system having the least amount of exercises.

Each handle strapping 120 connects to the handle 110 by passing through the hollow cylinder running the length of the handle 110. This allows the handle strapping 120 to move freely and prevents binding. The other end of the handle strapping 120 attaches to a D-ring 130. A third snap hook 140 is coupled to each D-ring 120.

Each third snap hook 140 is attached to one of the split upper fabric strappings 150. The third snap hook 140 allows for either or both of the handles to be removed or attached to each other. The third snap hooks 140 can also be used to join other training attachments to the strapping system.

The upper fabric strapping 160 is the extension of both split upper fabric strappings 150. The upper fabric strapping 160 is stiff to give rigidity. It attaches to the swivel snap 180 which serves two functions. The swivel allows the weighted pouch area that consists of the external fabric strapping 200, the internal fabric strapping 210 and the mesh retaining fabric 220, to rotate and not bind. The snap allows it to be attached to the upper strapping assembly.

The external fabric strapping 200, internal fabric strapping 210 and mesh retaining fabric 120 are all joined together and attach directly to a D-ring 190. The D-ring(s) 190 are placed together to secure the weighted pouch to attach to the upper strapping system. It also allows for various size medicine balls to fit into the pouch.

For the invention to be useful, a weight must be utilized. The external fabric strapping 200, internal fabric strapping 210 and mesh retaining fabric 220 are designed to act as a pouch to hold a variety of weights. Primarily, the pouch will hold a medicine ball as it allows for the most diversity of techniques that can be used during training. The pouch allows for various size and weights of medicine balls to be held.

Figure 6:
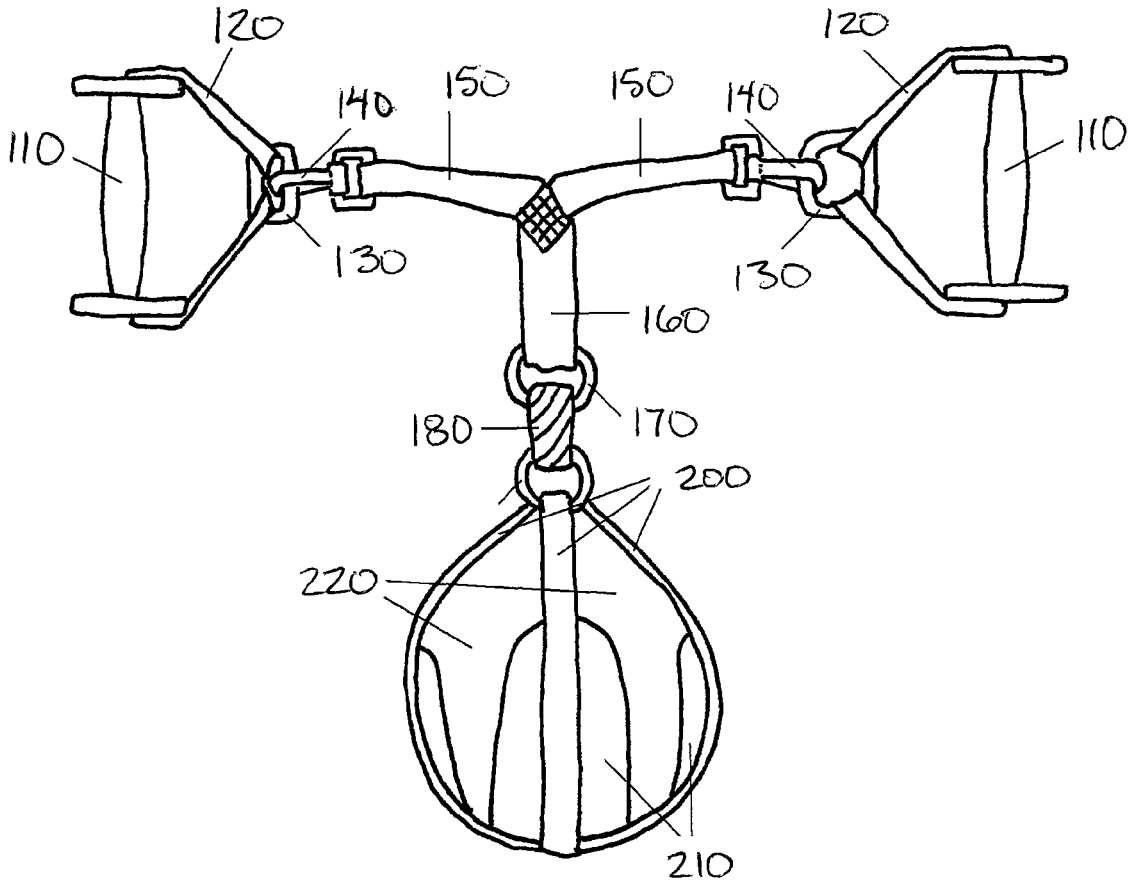
FIG. 6 is a front elevational view of a second embodiment of the exercise device with the hand grips shown spread apart.
Figure 7:
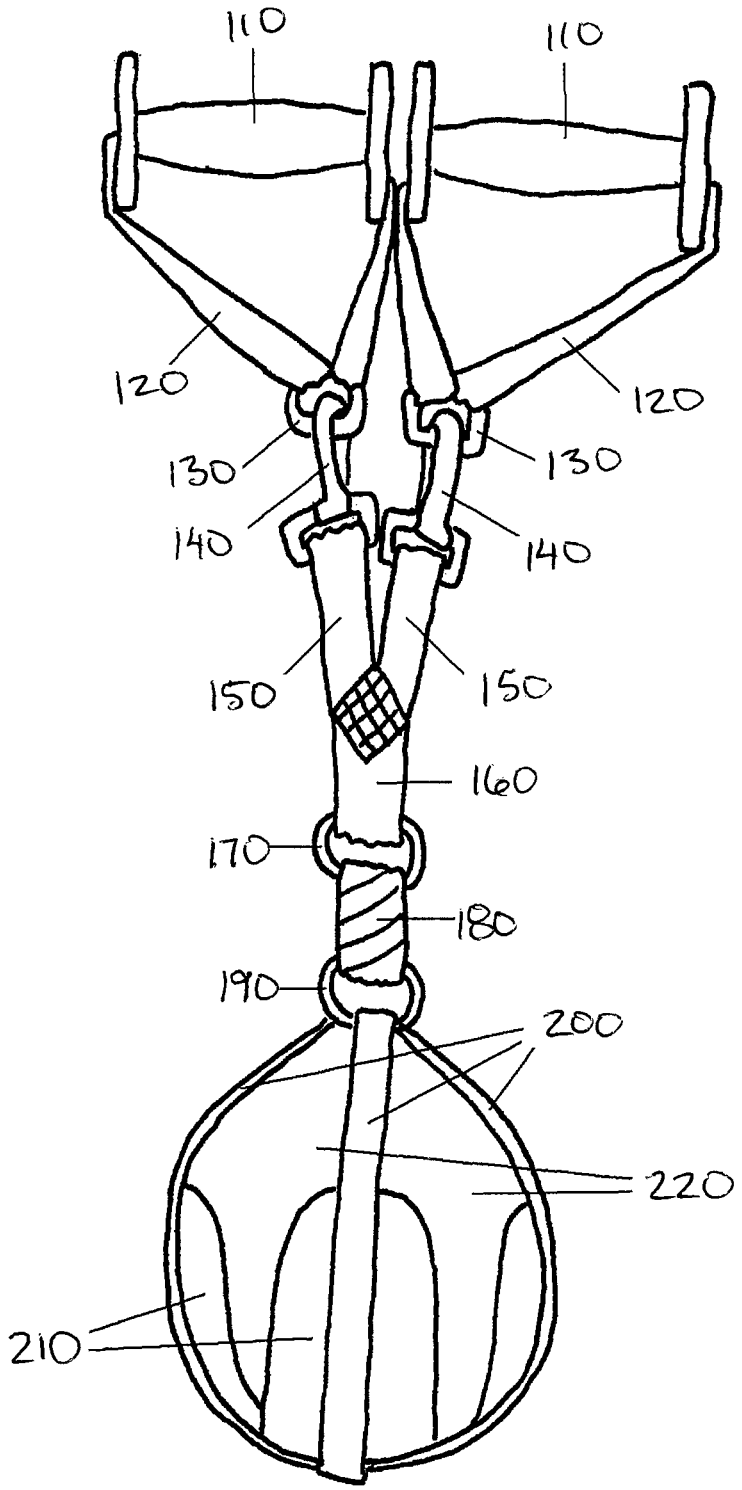
FIG. 7 is a front elevational view of the device according to FIG. 6 with the hand grips shown adjacent to one another.
Figure 8:
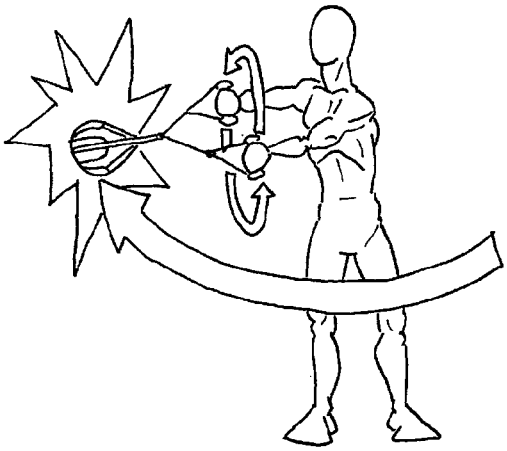
FIG. 8 and FIG. 9 are perspective views of a dynamic use of the device according to FIG. 6.
Figure 9:
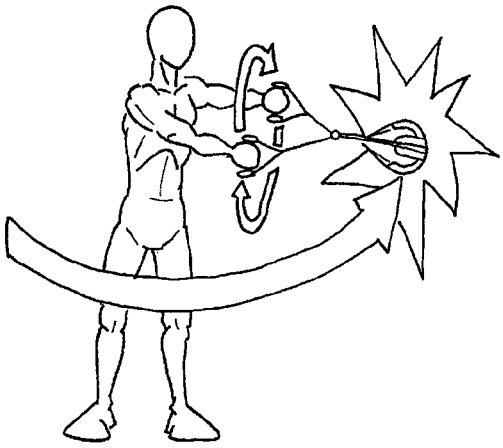
Figure 10:
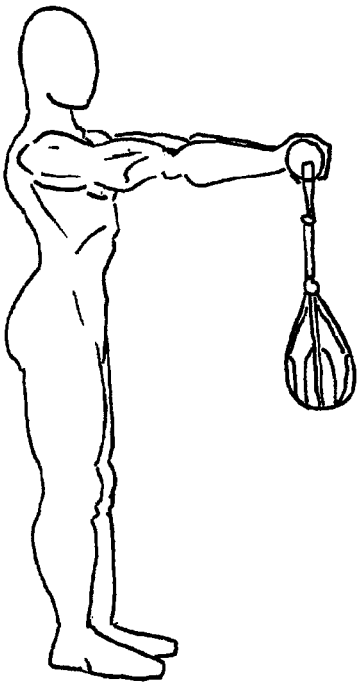
FIGS. 10 and 11 are perspective views of a static use of the device according to FIG. 6.
Figure 11:
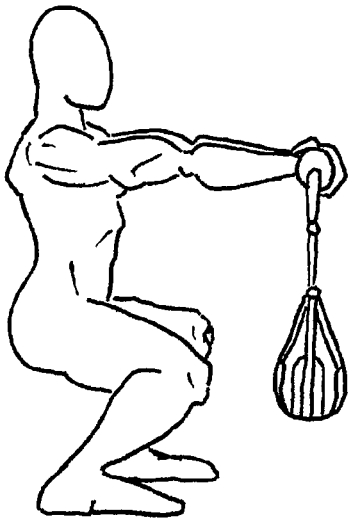

When the handles 110 are attached in the manner identified in FIG. 6 and FIG. 7 the strapping system will allow for the user to use each hand to hold each separate handle 110. This creates the ability for the system to be used for both dynamic exercises as demonstrated in FIGS. 8 and 9 and static exercises as demonstrated in FIGS. 10 and 11.

The split upper fabric 150 allows for the arms and hands of the user to be moved and adjusted in an unlimited number of planes during dynamic use of the training device. This includes multi directional rotation as indicated by the arrows in FIGS. 8 and 9. The split upper fabric 150 allows for static tension exercises by creating the ability to create muscle tension in directions that are not restricted to only countering the gravitational pull from the weight.

For more concentrated dynamic and static exercises, the two split upper fabric 150 extensions can be hooked together by having the snap hooks 140 attach to a single handle 110. This allows the device to be used for dynamic and static exercises that utilizes only one arm.

Finally, the third snap hooks 140 can be detached from the handles so various other training attachments could be used. Such as cloth attachment to replicate clothing in grappling sports, simulated end of a baseball bat, simulated end of a hockey stick, or any other grip training type of attachment.

In alternative embodiments, different materials, sizes and interconnections can be used for all components. For example, in lieu of handles, various other training attachments could be used such as a cloth attachment to replicate clothing in grappling sports, a simulated end of a baseball bat, a simulated end of a hockey stick, or any other grip training type of attachment. Furthermore, an elastic component could be used in place of the fabric strapping. Furthermore, various features of the second embodiment of FIGS. 6 through 11 may be used interchangeably with corresponding features in the first embodiment of FIG. 1 through 5.

Use of the preferred embodiment of the device shown in FIGS. 1 through 4 will now be described in further detail with particular reference to FIGS. 12 through 18. In each instance, the user typically suspends a weighted member from the anchor loop at the outer end of the anchor member, grips the hand grips in respective hands, and pulls the hand grips laterally apart from one another such that the two support members are substantially coplanar and the anchor member is perpendicularly oriented relative to the two support members so as to suspend the weighted member below the common pivotal axis in a working configuration of the device best shown in FIG. 18. The user then displaces the weighted member through a range of motion while maintaining the device in the working position of FIG. 18 such that the two support members remain substantially coplanar with one another and the anchor member remains perpendicularly oriented relative to the two support members so as to suspend the weighted member below the common pivotal axis from a starting position to an ending position of the designated exercise.

Figure 12:
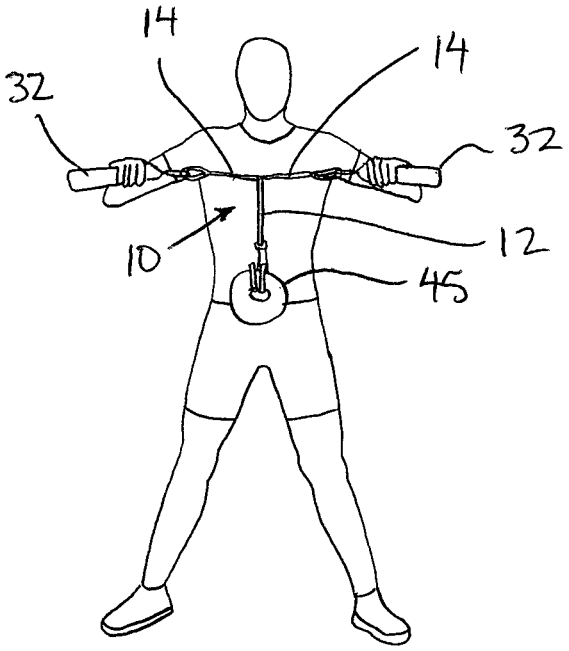
FIGS. 12 and 13 are front elevational views of the device being used during a squat exercise.
Figure 13:
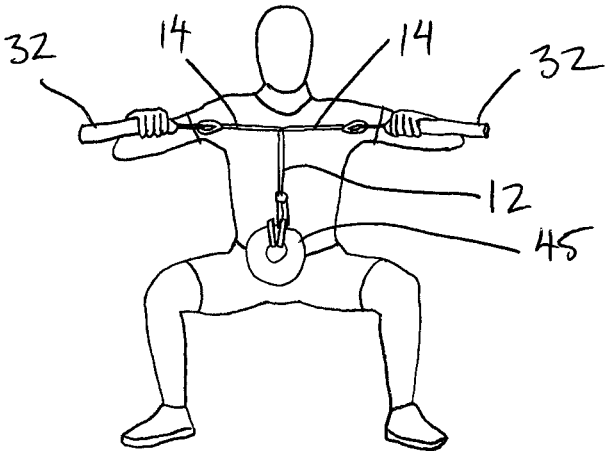

FIGS. 12 and 13 show the starting and ending positions respectively of a squatting exercise. In this instance, the user stands in the starting position with the arms of the user extending forwardly and the hand grips at a shoulder spacing relative to one another. The user performs the squat by bending their legs from the starting position to the ending position while the arms of the user remain extending forwardly and the hand grips at a shoulder spacing relative to one another.

Figure 14:
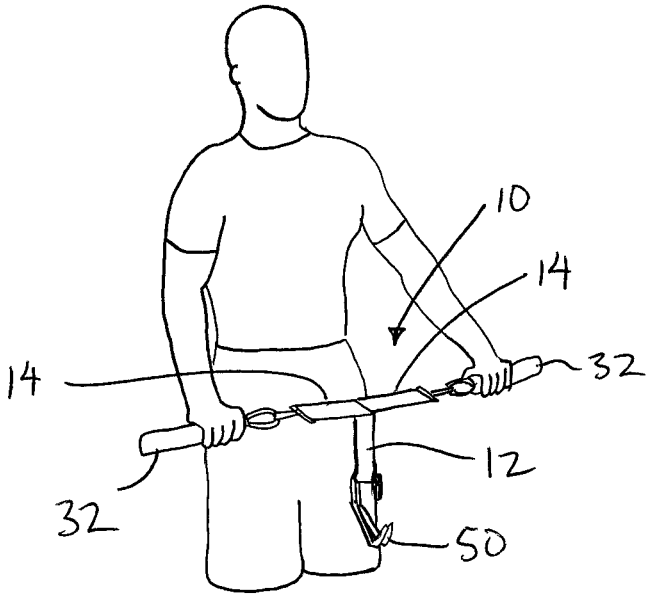
FIGS. 14 and 15 are perspective view of the device being used during a shoulder flexion exercise.
Figure 15:
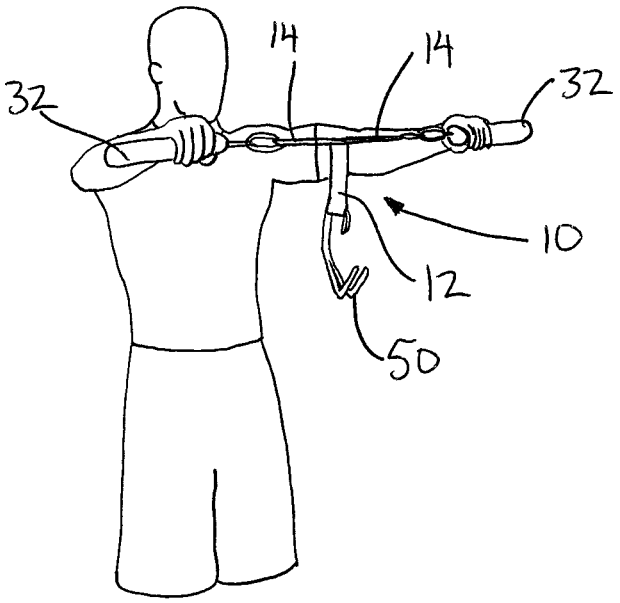

FIGS. 14 and 15 show the starting and ending positions respectively of a shoulder flexion exercise. In this instance the user extends their arms downwardly with the hand grips at a shoulder spacing relative to one another in the starting position. The user raises their arms from the starting position to the ending position in which the arms of the user extend forwardly and the hand grips are at a shoulder spacing relative to one another.

Figure 16:
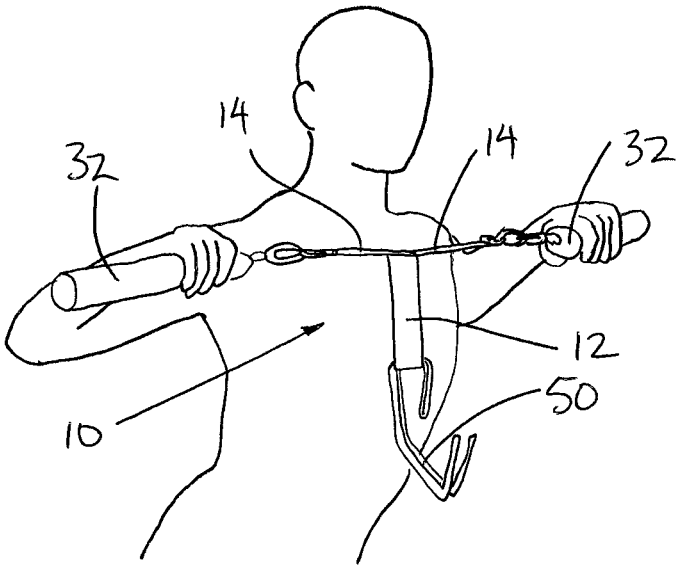
FIGS. 16 and 17 are perspective views of the device being used during a chest press exercsise.
Figure 17:
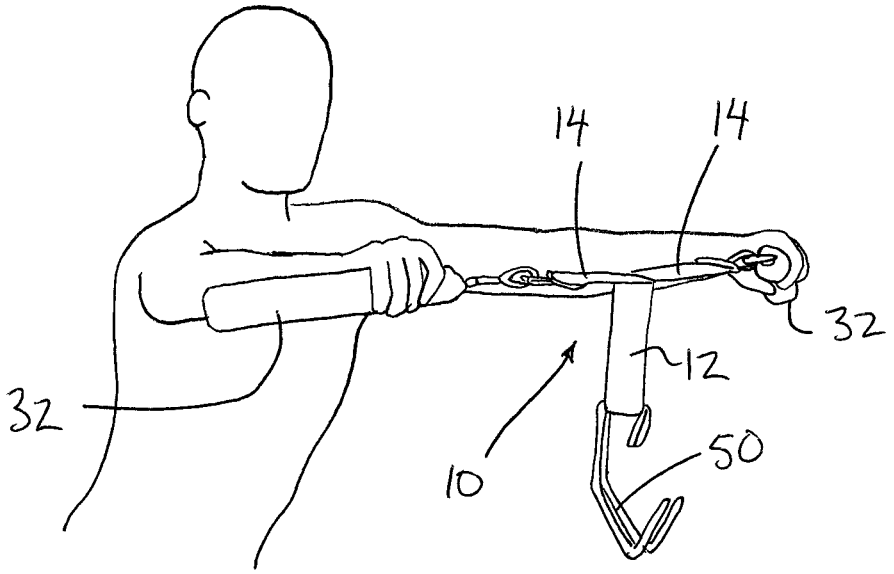

FIGS. 16 and 17 show the starting and ending positions respectively of a chest press exercise. In this instance the user extends their upper arms laterally outwardly in opposing directions with the hand grips at a shoulder spacing relative to one another in proximity to shoulders of the user in the starting position. The user extends their arms forwardly from the starting position to the ending position in which the arms of the user extend forwardly and the hand grips remain at a shoulder spacing relative to one another.

According to a bent over row exercise (not shown), the user initially leans their torso forwardly and extends their arms downwardly with the hand grips at a shoulder spacing relative to one another in the starting position. The user raises their arms from the starting position to the ending position in which the arms of the user are folded and the hand grips are at a shoulder spacing relative to one another in proximity to shoulders of the user.

Figure 18:
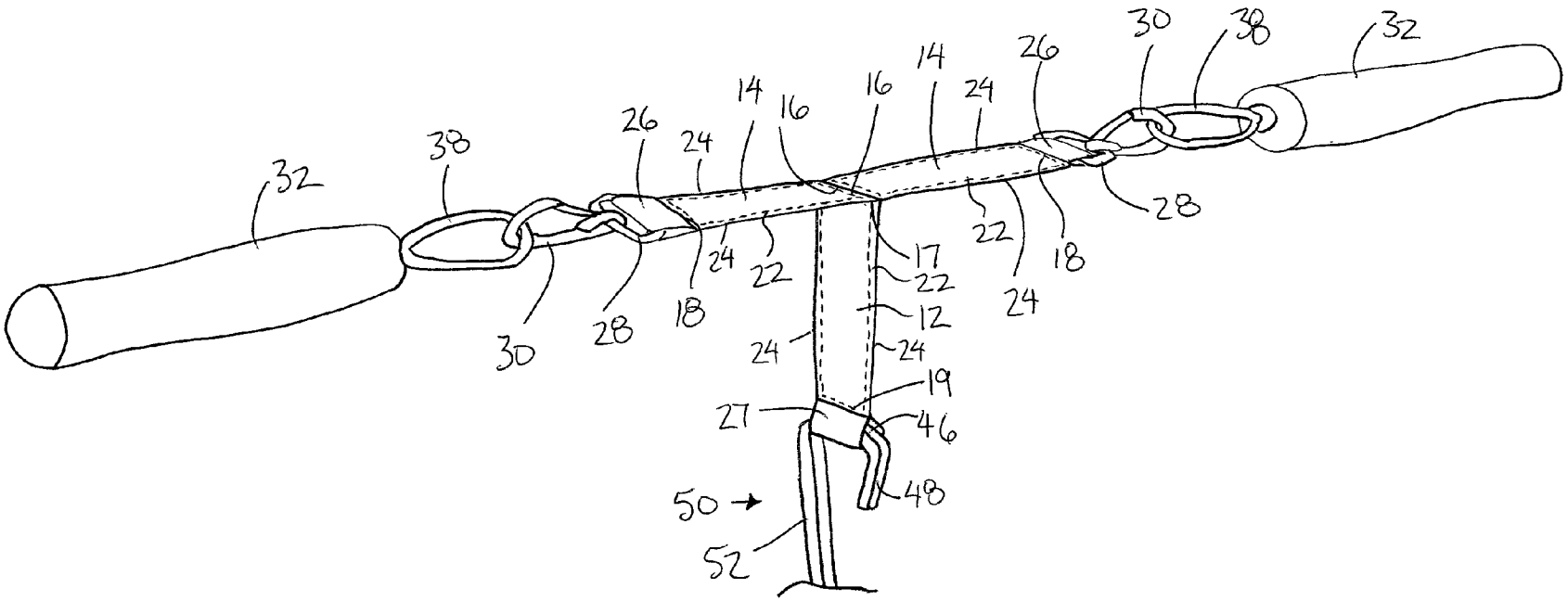
FIG. 18 is an enlarged perspective view of the device in a T-shaped working position.

Various additional exercises can also be performed by displacing the weighted member through various ranges of motion while flexing different body portions of the user, typically while always maintaining the hands of the user at a shoulder spacing relative to one another such that the device remains generally in the working configuration of FIG. 18.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. An exercise device comprising:

an anchor member which is flat, inelastic and fixed in length between an inner end and an outer end of the anchor member, wherein the anchor member comprises a flat strap having a width between two opposing side edges;

an anchor loop fixed to the outer end of the anchor member;

two support members, wherein each support member is substantially rigid and inelastic and is fixed in length between an inner end pivotally coupled to the inner end of the anchor member and an outer end opposite from the inner end, and wherein each support member comprises a rigid core body which is flat in a plane spanning between opposing longitudinal sides of the rigid core body, and two outer layers which are flat between two opposing side edges that span a length of the support member between the inner end and the outer end thereof, wherein the two outer layers are joined, face-to-face to one another along their two opposing side edges, wherein the rigid core body is received between the two outer layers along the full length between the inner end and the outer end of the support member, wherein each support member is pivotally connected to the anchor member about a common pivotal axis across the full width of the support member and the anchor member, and wherein each rigid core body extends to the inner end of its enclosing outer layers, to terminate substantially at the common pivotal axis, such that the common pivotal axis is parallel to the outer layers, the plane of each rigid core body, and the anchor member;

a support loop fixed to the outer end of each support member; and an independent hand grip coupled to the support loop of each support member wherein the hand grip is configured to be gripped by a user's hand, wherein the exercise device is configured to support a weight, suspended from the anchor loop at the outer end of the anchor member when the hand grips are pulled laterally apart from one another.

2. The device according to claim 1, wherein each support member has a fixed length of 4 to 12 inches between its inner outer end.

3. The device according to claim 1, wherein each support member has a fixed length of 5 to 7 inches between its inner and outer end.

4. The device according to claim 1, wherein the anchor member has a fixed length of less than 12 inches between its inner and outer end.

5. The device according to claim 1, wherein the gripping portion of each hand grip comprises a generally cylindrical gripping body which is elongate in the longitudinal direction of the hand grip.

6. The device according to claim 5, wherein the generally cylindrical gripping body of each hand grip varies in diameter along its length, from the end coupled to the support loop to the free end, to define lobed portions and recessed portions at various positions along its length.

7. The device according to claim 5, wherein each independent hand grip further comprises a swivel for coupling the hand grip to a support member.

8. The device according to claim 1, further comprising:

a hook member supported on the anchor loop; and a free-weight disc supported on the hook member.

9. The device according to claim 1, further comprising:

a hook member supported on the anchor loop; and a bag member supported on the hook member and having:

a hollow interior;

an open top end;

a plurality of anchor loops mounted at spaced positions about the open top end and configured to be secured on the hook member; and a plurality of sand bags configured to be inserted through the open top end and held in the hollow interior.

10. The device according to claim 1, further comprising:

a hook member supported on the anchor loop; and a ball supporting device comprising:

a plurality of strap members coupled to one another to define a receptacle with an open top end arranged to receive a weighted ball; and a plurality of anchor loops connected to the strap members and configured to be secured on the hook member.

* * * * *